United States Patent [19]

Wakita et al.

[11] Patent Number: 4,773,218

[45] Date of Patent: Sep. 27, 1988

[54] PULSE ACTUATED HYDRAULIC PUMP

[75] Inventors: Naomasa Wakita; Kanji Ohya; Masatoshi Kuwata; Shuzo Hattori; Makoto Okuda, all of Aichi, Japan

[73] Assignee: NGK Spark Plug Co., Ltd., Aichi, Japan

[21] Appl. No.: 875,690

[22] Filed: Jun. 18, 1986

[30] Foreign Application Priority Data

Jun. 18, 1985 [JP] Japan ..... 60-133458
Jun. 18, 1985 [JP] Japan ..... 60-133459
Jun. 18, 1985 [JP] Japan ..... 60-133460

[51] Int. Cl.[4] ..... F16D 31/02

[52] U.S. Cl. ..... 60/476; 60/473; 60/493; 417/315; 417/322; 417/412; 417/505

[58] Field of Search ..... 417/412, 322, 505, 315, 417/472; 60/473, 476, 493

[56] References Cited

U.S. PATENT DOCUMENTS 987,962 3/1911 Courtney ..... 417/315
2,995,012 8/1961 Cassaday et al. ..... 60/476
3,130,333 4/1964 Freye ..... 417/412
3,153,317 10/1964 Manor et al. ..... 60/476
3,406,670 10/1968 Hines ..... 417/412
3,477,177 11/1969 Tucker, Jr. ..... 60/473
3,987,625 10/1976 Swatty et al. ..... 60/459
4,344,743 8/1982 Bessman et al. ..... 417/322

FOREIGN PATENT DOCUMENTS 2717578 11/1978 Fed. Rep. of Germany ..... 417/322
1382439 11/1964 France ..... 417/412

*Primary Examiner*—Donald E. Stout
*Attorney, Agent, or Firm*—Finnegan, Henderson, Farabow, Garrett and Dunner

[57] ABSTRACT

A pulse-actuated hydraulic pump includes a hydraulic chamber with a bellows having a volume increased or decreased by the selective application a force in an axial direction thereof by a piezoelectric actuator. Control means control electrically-driven valves to selective discharge fluid from the bellows in precisely controllable volumes through a first pumping port or a second pumping port.

2 Claims, 9 Drawing Sheets

PULSE ACTUATED HYDRAULIC PUMP

FIELD OF THE INVENTION

This invention relates to a pulse-actuated hydraulic pump using a piezo-electric actuator.

BACKGROUND OF THE INVENTION

Conventional hydraulic apparatus comprising a hydraulic pump, an accumulator, a solenoid valve, an actuator (hydraulic cylinder), etc., has the following drawbacks:

(A) The hydraulic apparatus is complicated in construction and unavoidably large-sized;

(B) The slide faces allow oil leakage; and (C) The operation of the solenoid valve at a frequency higher than several hundred cycles is not possible because of its inferior frequency characteristics.

For the above reasons, the conventional hydraulic apparatus is unsuitable for a wide range of applications, e.g., a robot, because it is incapable of satisfactorily meeting requirements such as compactness, lightness in weight, accuracy in positioning, and quickness in response.

OBJECTS AND SUMMARY OF THE INVENTION

Objects of the present invention are to provide a lightweight, compact pulse-actuated hydraulic pump and attachment devices which are excellent in response capability and able to control an extremely small amount of oil.

These and other objects are achieved by a pulse-actuated hydraulic pump comprising a bellows hydraulic chamber, the capacity of the hydraulic chamber being decreased or increased by the force applied in the axial direction thereof, a piezoelectric actuator for applying force in the axial direction of the bellows hydraulic chamber and controlling the increase and decrease of the capacity thereof, a first electrically-driven valve installed between the bellows hydraulic chamber and a first pumping port, a second electrically-driven valve installed between the bellows hydraulic chamber and a second pumping port, a pulse supply for applying pulse voltage to the piezoelectric actuator and generating pressure in the axial direction of the hydraulic chamber, and control means for implementing a first driving form, wherein there are alternately taken a discharge step for sending oil out of the first pumping port by opening the first electrically-driven valve and shutting the second electrically-driven valve substantially synchronously with the increase in the capacity of the bellows hydraulic chamber and a sunction step for introducing the oil from the second pumping port by shutting the first electrically-driven valve and opening the second electrically-driven valve substantially synchronously with the decrease of the capacity of the bellows hydraulic chamber.

BRIEF DESCRIPTION OF THE DRAWING

The manner by which the above objects and other objects, features, and advantage of the present invention are attained will become fully apparent from the following detailed description when it is considered in view of the drawings, wherein.

DESCRIPTION OF THE PREFERRED EMBODIMENT

Figure 1:
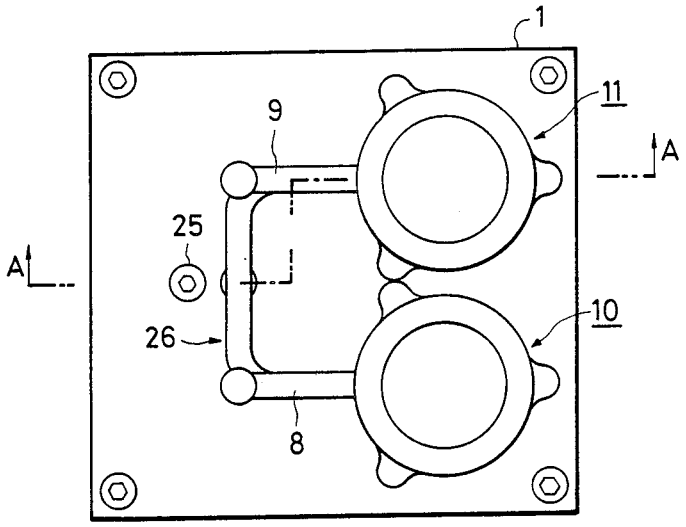
FIG. 1 is a plan view of the pulse-actuated hydraulic pump of the present invention.
Figure 2:
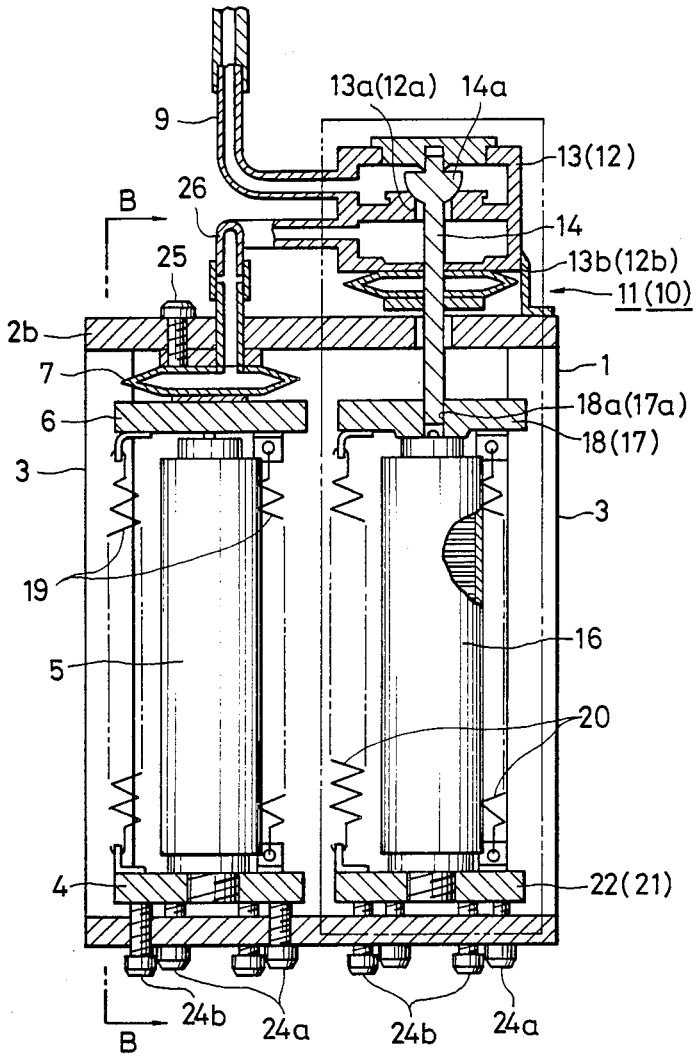
FIG. 2 is a sectional view taken on line A—A of FIG. 1.
Figure 3:
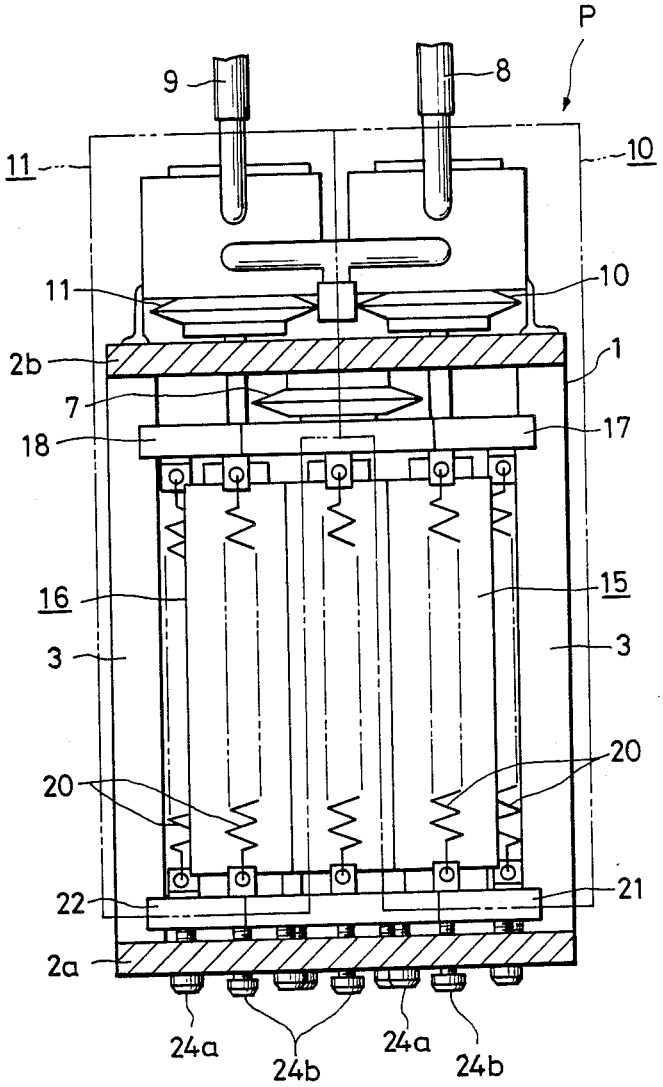
FIG. 3 is a sectional view taken on line B—B of FIG. 2.
Figure 4:
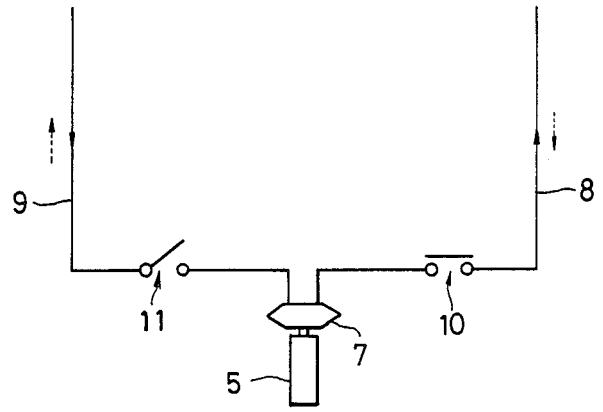
FIG. 4 is a hydraulic circuit for the pulse-actuated hydraulic pump of FIG. 1.

In the present invention, special attention has been devoted to the minute displacement of a piezoelectric actuator. The capacity of a hydraulic chamber equipped with bellows is changed by increasing or decreasing the force applied in the axial direction of the bellows hydraulic chamber by means of the piezoelectric actuator. Pulse-actuated hydraulic pressure is generated by controlling electrically-driven valves installed between the bellows hydraulic chamber and a first pumping port and a second pumping port relative to the piezoelectric actuator.

More specifically, the present invention is concerned with a pulse-actuated rotary driving gear for obtaining rotary displacement by conducting the movement of a bellows actuator resulting from the inflow or outflow of oil using the pulse-actuated hydraulic pump. A pulse-actuated linear reciprocating driving gear obtains linear displacement from the movement of the bellows actuator generated by the inflow or outflow of oil by means of the pulse-actuated hydraulic pump. It thereby becomes possible to provide a pulse-actuated hydraulic pump incorporating a control device excellent in response capability and capable of controlling an extremely small amount of oil.

Referring now to the accompanying drawings, the construction of the pulse-actuated hydraulic pump according to the present invention will be described.

A rectangular frame body 1 is provided with a fitting space formed with supports 3 at four corners across a lower plate 2*a* and an upper plate 2*b*. In the fitting space, a base 4 is fixed onto the lower plate 2*a* with fixing screws 24*a* and adjusting screws 24*b*, whereas a piezoelectric actuator 5 comprising a plurality of integrated piezoelectric element plates is installed on the base 4, the surface and under surface electrodes of the piezoelectric element plates are connected in parallel, respectively.

The upper end of the piezoelectric actuator 5 is energized in the direction of nip pressure by a pressurized spring 19 installed between a flange 6 arranged on top of the actuator 5 and the base 4. A bellows hydraulic chamber 7 is soldered onto the flange 6 and the surface of the bellows hydraulic chamber 7 is fixed to the upper plate 2*b* with a screw 25. The interior of the bellows hydraulic chamber 7 communicates with a first electrically-driven valve 10 and a second electrically-driven valve 11 through ductwork 26 that passes through the upper plate 2b.

The electrically-driven valves 10, 11 will subsequently be described.

The first electrically-driven valve 10 is installed between the bellows hydraulic chamber 7 and a first pumping port 8, whereas the second electrically-driven valve 11 is installed between the bellows hydraulic chamber 7 and a second pumping port 9.

The electrically-driven valves 10, 11 are the same in construction and use piezoelectric actuators 15, 16 as driving sources. The actuators 15, 16 respectively comprise pluralities of integrated piezoelectric element plates and are supported on bases 21, 22 adjusted and fixed to the lower plate 2a with screws 24a, 24b. The upper ends of the piezoelectric actuators 15, 16 are respectively energized in the directions of nip pressure by flanges 17, 18 arranged on top of the actuators 15, 16 and pressurized springs 20. The flanges 17, 18 are respectively provided with through holes 17a, 18a into which the bases of valve levers 14 are inserted and the lower ends thereof abut on and make contact with the upper ends of the piezoelectric actuators 15, 16. The upper ends of the valve levers 14 pass through the upper plate 2b and are respectively inserted into valves 12, 13.

The valves 10, 11 are fixed to the upper plate 2b and respectively equipped with compartments for dividing the interiors into two upper and lower chambers. The valve levers 14 pass through the compartments and are used to mount valve bodies 14a on valve seats 12a, 13a installed in the compartments. Valve bellows 12b, 13b are installed beneath the valves 10, 11. The surfaces of the valve bellows 12b, 13b are fusion-welded to the under surfaces of the valves 10, 11 and the lower plates thereof are fixed with a liquid tight seal to the valve levers 14 so that the lower plates may follow the elevation of the valve levers 14.

In the through holes 17a, 18a of the flanges 17, 18, there is actually a small gap between each of the lower ends of the valve levers 14 and each of the upper ends of the piezoelectric actuators 15, 16 while no pulse voltage is applied to the piezoelectric actuators 15, 16, whereby the valve bodies 14a, 14a of the valve levers 14, 14 are caused to be tightly seated on the valve seats 12a, 13a by the downwardly energizing force of the valve bellows 12b, 13b to ensure that the valves remain closed. Such adjustment is implemented by the adjusting screws 24b. When the pulse voltage is applied to the piezoelectric actuators 15, 16, moreover, the valve levers 14 of the valves come in contact with the upper ends of the piezoelectric actuators 15, 16, causing the valve seats 12a, 13a to separate from the valves bodies 14a, 14a, and open the valves.

In the above-described construction, the fixing screws 24a are fitted into the threaded holes made in the lower plate 2a and the base 4. The adjusting screws 24b pass through the lower plate 2a with their front ends abutting on the under surface thereof so as to make fine adjustments on the piezoelectric actuators 5, 15, 16 in terms of their height and horizontal positions.

The operation of the pulse-actuated hydraulic pump thus constructed will be described. During the step of discharging oil from the first pumping port 8, the piezoelectric actuator 16, i.e., the driving source of the second electrically-driven valve 11 is turned off under electrical control and kept free from the application of a voltage. The valve lever 14 of the valve 10 is downwardly energized by the spring properties of the valve bellows 13b. The second electrically-driven valve 11 is closed because of the valve body 14a.

When a voltage is subsequently applied to the external piezoelectric actuator 15 as the driving source of the first electrically-driven valve 10, the actuator 15 extends and causes the valve lever 14 of the valve 10 to rise in resistance to the energizing force of the valve bellows 12b. As the valve body 14a floats up the valve seat 12a within the valve 12, the first electrically-driven valve 10 is opened. Voltage is then applied to the piezoelectric actuator 5, which is displaced in the direction of extension, whereby oil is discharged as the capacity of the bellows hydraulic chamber decreases. At that time, 0.06 cc of oil is discharged from the first pumping port 8 in a cycle by setting the displacement at about 40 $\mu$m and the effective diameter of the bellows of the bellows hydraulic chamber 7 at 30 $\phi$.

During the step of sucking oil from the second pumping port 9, the voltage is removed from the piezoelectric actuator and it is restored from its extended state to its original state by means of the pressurized spring 20. Consequently, the valve lever 14 is lowered by the spring properties of the valve bellows 12b and the first electrically-driven valve 10 is closed. The voltage is then applied to the piezoelectric actuator 16 to set the actuator in an extended state and to open the second electrically-driven valve 11. The application of voltage to the piezoelectric actuator 5 is released and it is restored to the original state. As the capacity of the bellows hydraulic chamber 7 increases, oil is sucked (e.g., 0.06 cc) from the second pumping port 9 into the bellows hydraulic chamber 7.

The application and release of voltage to and from each piezoelectric actuator 5, 15, 16 are carried out by a pulse supply, so that the suction and discharge of oil are continuously repeated at high speed in accordance with the supply pulse cycle. In other words, if a pulse supply at 5 kilocycles/sec is employed for driving purposes, 300 cc/sec of oil will continuously be sent out of the first pumping port 8 in the form of pulsation.

Oil is discharged from the first pumping port 8 during the above step and can also be discharged from the second pumping port 9. In the case of the latter, the piezoelectric actuator 5 is extended while the first electrically-driven valve 10 is closed and the second electrically-driven valve 11 is opened during the discharge step so as to decrease the capacity of the bellows hydraulic chamber 7. The piezoelectric actuator 5 is moved back while the first electrically-driven valve 10 is opened and the second electrically-driven valve 11 is closed during the suction step so as to increase the capacity of the bellows hydraulic chamber 7.

Figure 5:
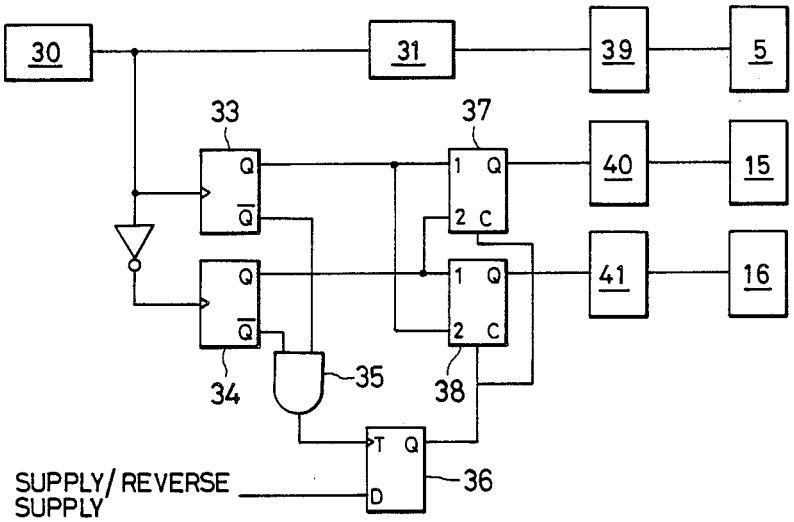
FIG. 5 is a block diagram showing an example of a control means for use with the pump of FIG. 1.

FIG. 5 is a block diagram showing control means embodying the present invention for controlling the application of pulse voltage. The respective functions of elements constituting the control means will subsequently be described.

The control means comprises an oscillator 30 for generating a clock pulse at a duty ratio of about 50% with a pulse width of $T_1$, a delay element 31 for delaying an input signal (square wave) by $T_2$ and producing the same. Monomultiplexers 33, 34 are triggered when the signal applied to a terminal T rises and are used to produce a signal having a pulse width of $T_3$. A latch 36 latches the signal of a terminal D when the signal applied to the terminal T rises and supplies the signal to a terminal Q. Multiplexers 37, 38 select the signal applied to the terminal 1 or 2 according to the control signal applied to a terminal C, supply to the terminal Q, the signal of the terminal 1 when the voltage at the terminal C is Hi and the signal of the terminal 2 when the voltage at the terminal C is Lo. Drivers 39–41 comprise amplifiers and used to amplify the level of the input signal to a level suitable for driving the piezoelectric actuators.

Figure 6:
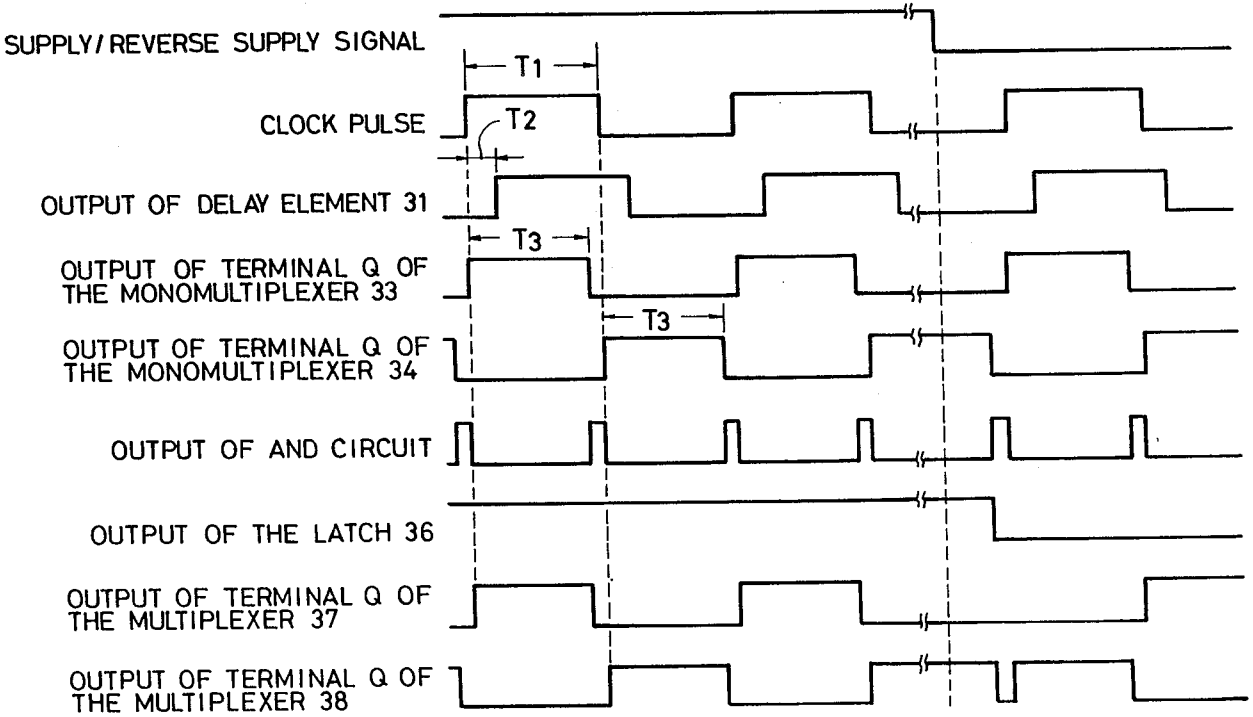
FIG. 6 is a time chart of the operation of the control means of FIG. 5.

FIG. 6 is a time chart for illustrating the operation of the control means of FIG. 5 in order to supply continuously pulsating hydraulic oil in one direction by controlling the piezoelectric actuators 5, 15, 16 so as to repeat the discharge and sunction of the hydraulic oil in the bellows hydraulic chamber 7 and to reverse the direction of the hydraulic oil supply depending on the forward supply/reverse supply signals.

Referring to FIGS. 5, 6, the operation of the control device according to this embodiment will be described.

The clock pulse produced by the oscillator 30 is delayed by time $T_2$ when it passes through the delay element 31 and is used to drive the piezoelectric actuator 5 after being converted into an optimum voltage level through the driver 39.

The Q outputs of the monomultiplexer 33 are triggered when the clock pulse rises are supplied to the terminal 1 of the multiplexer 37 and the terminal 2 of the multiplexer 38. When the output of the terminal Q of the latch 36 is Hi, a signal voltage synchronous with the Q output of the monomultiplexer 33 is applied to the piezoelectric actuator 15 through the driver 40. When the output of the terminal Q of the latch 36 is Lo, a signal voltage synchronous with Q output of the monomultiplexer 33 is applied to the piezoelectric actuator 16 through the driver 41.

The Q outputs of the monomultiplexer 34 are triggered when the clock pulse decays and are supplied to the terminal 2 of the multiplexer 37 and the terminal 1 of the multiplexer 38. When the output of the terminal Q of the latch 36 is Hi, a signal voltage synchronous with the Q output of the monomultiplexer 33 is applied to the piezoelectric actuator 16 through the driver 41. When the output of the terminal Q of the latch 36 is Lo, a signal voltage synchronous with the Q output of the monomultiplexer 33 is applied to the piezoelectric actuator 15 through the driver 40.

The voltage is alternately applied to the piezoelectric actuators 15, 16 by the monomultiplexers 33, 34 and the multiplexers 37, 38 with the clock pulse as a trigger.

The delay time $T_2$ by the delay element 31 is set so that the operating time of the electrically-driven valves 10, 11 can be longer in order to satisfy $T_2<T_1$. The pulse width $T_2$ of the output of the monomultiplexers 33, 34 is set so as to satisfy the relation $T_2<T_3<T_1$ and cause the transfer of the hydraulic oil to be completed during $(T_3-T_2)$.

The above relationship among $T_1$, $T_2$ and $T_3$ allows the repitition of the following operations i–v while the forward supply signal is applied to the latch 36:

i. The electrically-driven valve 10 is opened;

ii. The extension signal is applied to the piezoelectric actuator 5 to drive the bellows hydraulic chamber 7 after the delay time $T_2$ and to discharge oil from the first pumping port 8;

iii. The electrically-driven valve 10 is closed upon completion of the hydraulic oil transfer according to the condition ii;

iv. The electrically-driven valve 11 is opened after the lapse of time $(T_1-T_3)$; and v. The voltage applied to the piezoelectric actuator 5 becomes Lo after the lapse of time $T_2$ and causes the actuator 5 to contract and the oil to be sucked from the second pumping port 9 as the capacity of the bellows hydraulic chamber 7 increases.

Subsequently, switching means for changing the discharge directions at the pumping ports 8, 9 will be described.

When the forward/reverse supply control signal provided to the terminal D of the latch 36 is inverted, the latch 36 produces, from its terminal Q, the signal inverted synchronously with the rise of the input on its T side from an AND circuit 35. Accordingly, the above output signal becomes synchronous with the timing at which the outputs on the Q sides of the monomultiplexers 33, 34 decay. The output signal allows the signal selection by the multiplexers 37, 38 to be controlled and the discharge directions of the pumping ports 8, 9 to be altered.

The driving signal for the electrically-driven valves 10, 11 is transferred from open to close when the outputs of the monomultiplexers 33, 34 decay. Accordingly, the latch 36 is designed to cause the inversion of the supply direction of hydraulic oil when the open electrically-driven valve 10 or 11 is closed after the predetermined time $T_3$ even though the forward supply/reverse supply signal is inverted anytime during the cycle of the clock pulse.

The monomultiplexers 33, 34 and the latch 36 are reset by an initial reset signal when power is supplied, and the description of such technique will be omitted because it is already well known.

According to the present invention, the control means is not necessarily equipped with a switching means. In this case, oil is discharged from, e.g., the first pumping port 8. A known solenoid valve may be used for the first and second electrically-driven valves 10, 11 and, in this case, the use of such a solenoid valve should be limited to a hydraulic apparatus which requires operating characteristics with a lower response capability.

The capacity of the bellows hydraulic chamber 7 is alternately increased and decreased by applying pulse voltage and giving minute pulse displacement to the piezoelectric actuator 5 to cause the discharge of oil in the form of pulsation, enables several benefits to be attained by the present invention. For example, very small amounts of oil can be controlled (e.g., given that the effective diameter of the bellows of the bellows hydraulic chamber is 30 $\phi$ and that the displacement of the piezoelectric actuator is 40 $\mu$m/cycle, 0.06 cc of oil per cycle is dischargeable).

Also, operating characteristics with high response capability can be obtained A large volume of oil supply is made possible. When the effective diameter of the bellows of the bellows hydraulic chamber was set at 30 $\phi$ with piezoelectric displacement at 40 $\mu$/cycle and 5 K cycle/sec, the amount of oil supplied can be 300 cc/sec. In addition, a hydraulic pump of small capacity with light weight is readily attainable.

Figure 7:
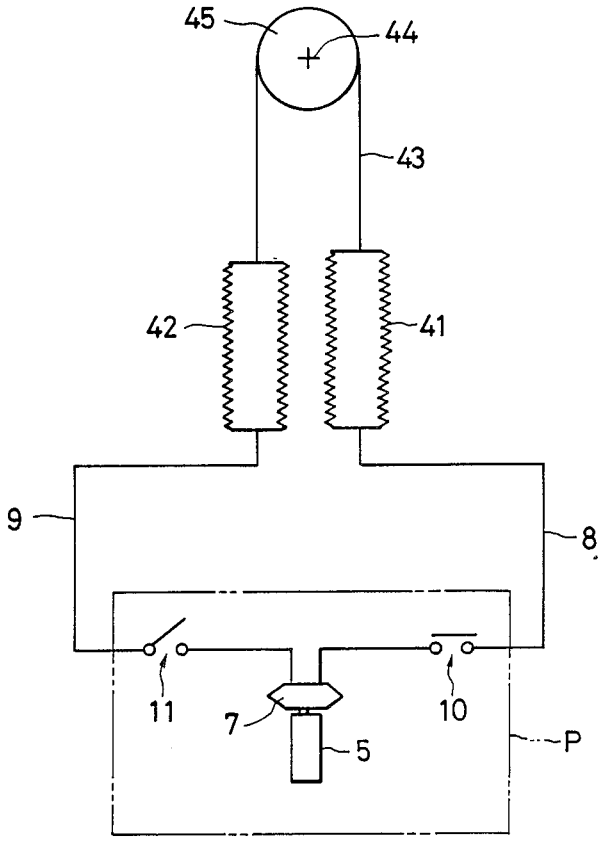
FIG. 7 is a hydraulic circuit diagram.
Figure 8:
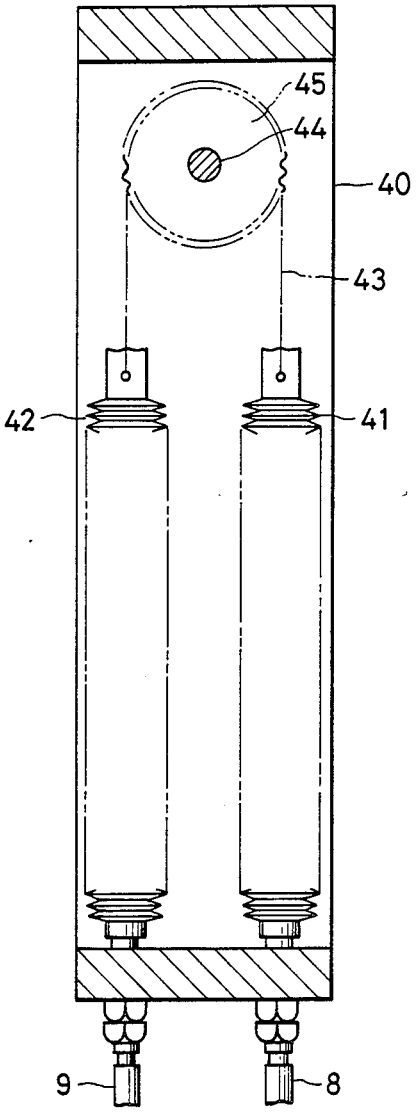
FIG. 8 is a vertical sectional elevational view illustrating the driving mechanism of a rotary shaft 44.
Figure 9:
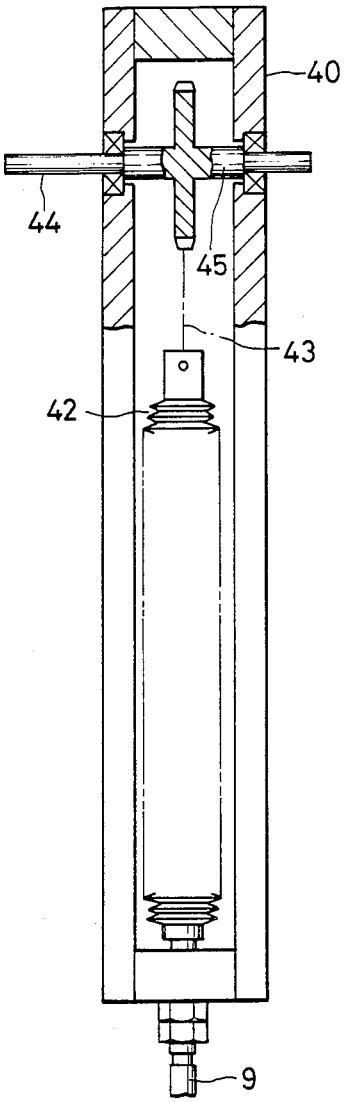
FIG. 9 is a cutaway side view of the mechanism of FIG. 8.

Referring to FIGS. 7–12, an actual application of the above pulse-actuated hydraulic pump will be described. FIGS. 7–9 show a pulse-actuated rotary driving gear using the pulse-actuated hydraulic pump. The rotary driving gear comprises the above-described pulse-actuated hydraulic pump, a first bellows actuator coupled to a first pumping port of the pulse-actuated hydraulic pump, a second bellows actuator coupled to a second pumping port of the pulse-actuated hydraulic pump, a second bellows actuator coupled to a second pumping port of the pulse-actuated hydraulic pump, a circular piece with one end connected to the free end of the first bellows actuator and its other end connected to the free end of the second bellows actuator, and a rotary shaft driven by the circular piece.

The rotary driving gear is characterized in that a very small revolution determined by one pulse of oil supplied by the pulse-actuated hydraulic pump may be applied to the rotary shaft. The circular piece with ends may mean a belt, rope, or chain with ends.

The piezoelectric actuator extends and contracts according to the pulse supply, thus causing the oil discharge and suction steps to be taken in the bellows hydraulic chamber through the control means. In such processing steps, oil is discharged from one bellows actuator and supplied to the other bellows actuator. The capacity of the bellows actuator on the outflow side decreases and allows its free end to pull the circular piece with ends, whereas the capacity of the bellows actuator on the supply side increases and causes its free end to be pulled correspondingly by the unidirectional tensile force of the circular piece. In consequence, the circular piece is moved in one direction to allow the extraction of rotary displacement of the rotary shaft corresponding to the number of voltage pulses applied to the hydraulic pump. Furthermore, rotary displacement in the direction opposite to the rotary shaft may be accomplished by switching the oil discharge direction of the hydraulic pump.

Referring to FIGS. 7–9, an arrangement of parts other than those constituting the pulse-actuated hydraulic pump P will be described.

The first pumping port 8 of the pulse-actuated hydraulic pump P is connected to one end of a bellows actuator 41 within a fitting frame 40 so as to communicate its interior with a pump P and make that end immovable. The second pumping port 9 is connected to one end of the second bellows actuator 42 so as to communicate its interior with the pump P and make that end immovable. The bellows actuators 41, 42 are vertically-extending, long bellows with free ends connected to the ends of the chain 43 with ends (circular piece with ends), respectively. The chain 43 with ends is wound on a sprocket 45 fixed to a rotary shaft 44 inserted into the fitting frame 40 through a bearing.

One end of the rotary shaft 44 protrudes externally from the fitting frame 40 and is used as an output terminal.

The operation of the above embodiment will be described. When a hydraulic pump P is driven so as to supply pulsating oil from the bellows hydraulic chamber 7 to the first pumping port 8 and suck the oil from the second pumping port 9, the capacity of the first bellows actuator 41 increases and causes its free end to rise, whereas the capacity of the second bellows actuator 42 decreases and causes its free end to fall. In consequence, the chain 43 with ends travels toward the second bellows actuator 42 and rotates the rotary shaft 44 counterclockwise in the drawing.

Since the angle of rotation is determined by the number of pulses of the pulse voltage applied to the piezoelectric actuator 5, that angle of rotation can precisely be controlled.

When the oil discharge direction of the hydraulic pump P is changed by the switching means, the displacement directions of the capacities of the bellows actuators 41, 42 are altered and the rotary shaft 44 is turned clockwise as their free ends rise and fall in opposite directions.

Assuming that the pulsating oil is discharged and sucked at 0.06 cc/cycle and that the effective diameter of the bellows actuators 41, 42 is 20 $\phi$, the displacement of the free end will be about 90 $\mu$m/cycle.

The rotary driving gear according to the present invention employs the pulse-actuated hydraulic pump P for alternately implementing oil discharge and suction steps corresponding to the pulse voltage applied to the piezoelectric actuator, causes the free ends of the first and second bellows actuators to be displaced by the pulsating oil, and drives the rotary shaft through the circular piece with ends so as to extract rotary displacement from the rotary shaft.

As will be readily understood, rotary displacement can be so controlled so as to minimize it. Also, operating characteristics with high response capability are obtained. For example, assuming that the pulse-actuated hydraulic pump is driven at 5 kilocycle/sec, the bellows of the bellows hydraulic chamber has an effective diameter of 30 $\phi$, the displacement of a piezoelectric actuator is 40 $\mu$m/cycle, and the bellows actuator has an effective diameter of 20 $\phi$, the transfer amount of the free end of the bellows actuator becomes 45 cm/sec and accordingly high-speed operation can be realized.

Figure 10:
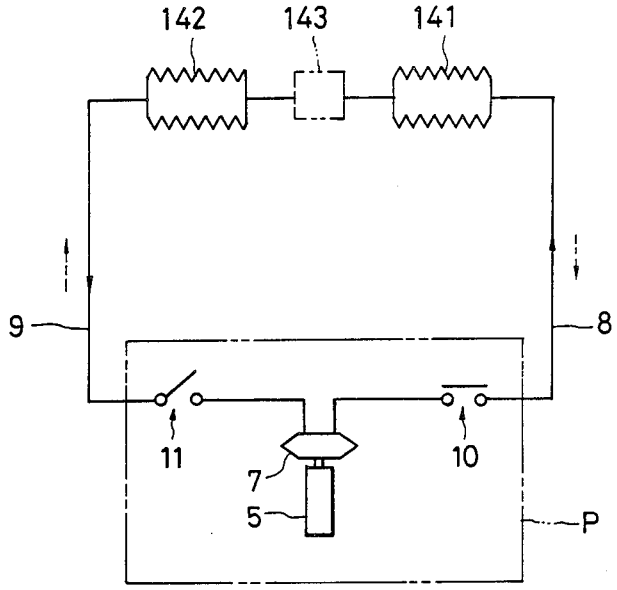
FIG. 10 is a hydraulic circuit diagram.
Figure 12:
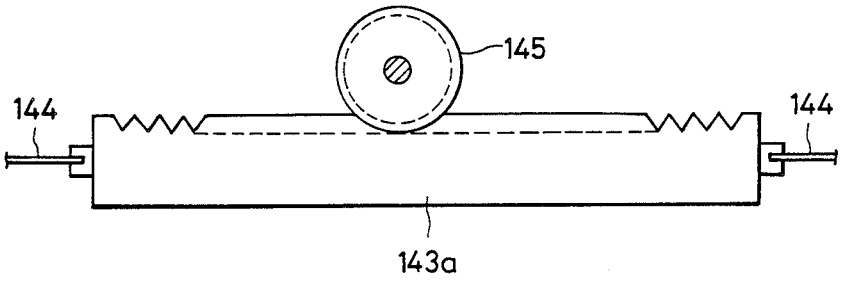
FIG. 12 is a side view showing an example of the utilization of the driving mechanism of FIG. 11.
Figure 11:
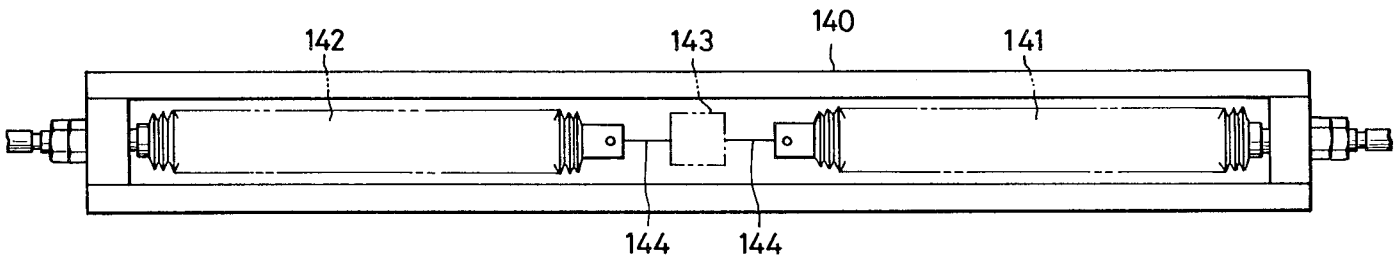
FIG. 11 is a vertical sectional elevational view illustrating the driving mechanism of a linear travel body 43.

FIGS. 10 through 12 show a pulse-actuated linear reciprocating gear using the pulse-actuated hydraulic pump. The pulse-actuated linear reciprocating gear includes the pulse-actuated hydraulic pump, a first bellows actuator coupled to a first pumping port of the pulse-actuated hydraulic pump, a second bellows actuator coupled to a second pumping port of the pulse-actuated hydraulic pump in such a manner that the first and second bellows actuators are linearly arranged with their operating ends facing each other, and a linear travel body arranged between the two bellows actuator having one end connected to the operating end of the first bellows actuator and its other end connected to the operating end of the second bellows actuator.

The pulse-actuated linear reciprocating gear is characterized in that a very small amount of displacement determined by the volume of oil supplied by one pulse of the pulse-actuated hydraulic pump is applied to the linear travel body.

The piezoelectric actuator extends and contracts according to the supply of pulses, thus causing the oil discharge and suction steps to be taken in the bellows hydraulic chamber through the control means. In such processing steps, oil is discharged from one bellows actuator and supplied to the other bellows actuator. The capacity of the bellows actuator on the outflow side decreases and allows its operating end to pull the circular piece with ends, whereas the capacity of the bellows actuator on the supply side increases and causes its operating end to be pulled correspondingly by the unidirectional tensile force of the circular piece. In consequence, the circular piece is moved in one direction and allows the extraction of linear directional displacement resulting from the linear travel body corresponding to the number of pulses of the voltage applied to the hydraulic pump. Furthermore, linear directional displacement in the direction opposite to the linear travel body is extracted by switching the oil discharge direction of the hydraulic pump.

Referring to FIGS. 10–12, an arrangement of parts other than those constituting the pulse-actuated hydraulic pump P will be described.

In a fitting frame 140, a first bellows actuator 141 and a second bellows actuator 142 are linearly arranged with their operating ends placed opposite to each other and the other ends movably fixed to the fitting frame 140. The first pumping port 8 of the pulse-actuated hydraulic pump P is connected to the fixed end of the first bellows actuator 141 and connect the interior thereof with the pump P. Furthermore, the second pumping port 9 is also connected to the fixed end of the second bellows actuator 142 and connects the interior thereof with the pump P. The bellows actuators 141, 142 are vertically bellows-shaped with operating ends connected to both ends of a linear travel body 143 with a rope 144, the linear travel body being provided between the bellows actuators 141, 142 so that they may be arranged linearly.

The linear travel body 143 can be of any shape as long as it is capable of extracting displacement in the linear direction.

FIG. 12 shows a rack 143*a* employed as the linear travel body 143 and a pinion 145 engaging with the rack 143*a*. It is thus possible to extract the rotary movement by properly engaging a converter means with the linear travel body.

The operation of this embodiment will be described. When the hydraulic pump P is driven so as to supply pulsating oil to the first pumping port 8 and cause the second pumping port 9 to suck oil, the capacity of the first bellows actuator 141 increases to make its operating end extend, whereas the capacity of the second bellows actuator 142 decreases to make its operating end retract. Consequently, the linear travel body 143 moves to the left in the drawing.

Since the displacement in the linear direction is determined by the number of pulses of the pulse voltage applied to the piezoelectric actuator 5, the displacement can be precisely controlled.

When the oil discharge direction of the hydraulic pump P is changed by the switching means, the directions wherein the capacities of the bellows actuators 141, 142 displace are altered and the directions wherein the operating ends expand and contract are reversed, thereby the linear travel body 143 moves to the right.

Assuming that pulsating oil is discharged and sucked in at a rate of 0.06 cc/cycle and that the effective diameters of the bellows actuators 141, 142 are 20 $\phi$, the displacement of the operating end becomes 90 $\mu$m/cycle.

The present invention employs the pulse-actuated hydraulic pump P for alternately carrying out oil discharge and suction steps corresponding to the pulse voltage applied to the piezoelectric actuator, causes the operating ends of the first and second bellows actuators to be displaced by the pulsating oil, and drives the linear travel body so as to extract displacement in the linear direction from the linear travel body. Accordingly, displacement in the linear direction can be so controlled as to minimize it and operating characteristics with high response capability can be obtained. For example, assuming that the pulse-actuated hydraulic pump is driven at 5 kilocycle/sec with the bellows of the bellows hydraulic chamber having an effective diameter of 30 $\phi$, the displacement of the piezoelectric actuator being 40 $\mu$m/cycle, and the bellows actuator having an effective diameter of 20 $\phi$, the transfer amount of the operating end of the bellows actuator becomes 45 cm/sec and high-speed operating can be realized.

It will be apparent to one skilled in the art that various modifications can be made to above-described embodiments of the present invention without departing from the scope and spirit of the following claims.

What is claimed is:

1. A pulse-actuated rotary driving gear comprising:

a bellows hydraulic chamber having a fluid capacity that may be decreased or increased by the selective application of a force applied in the axial direction thereof;

a piezoelectric actuator for applying said force in the axial direction of said bellows hydraulic chamber;

a first pumping port and a second pumping port;

a first electrically-driven valve installed between said bellows hydraulic chamber and said first pumping port having a valve lever and a piezoelectric actuator for displacing said valve lever to open and shut said valve;

a second electrically-driven valve installed between said bellows hydraulic chamber and said second pumping port having a valve lever and a piezoelectric actuator for displacing said valve lever to open and shut said valve;

a pulse supply for applying a pulse voltage to said piezoelectric actuator to generate pressure in the axial direction of said hydraulic chamber; and control means for implementing a first driving mode including a first discharge step for discharging fluid from said chamber through said first pumping port by opening said first electrically-driven valve and shutting said second electrically-driven valve substantially synchronously with the selective control of said force on said chamber to decrease the capacity of said bellows hydraulic chamber and a first suction step for intaking fluid into said chamber through said second pumping port by shutting said first electrically-driven valve and opening said second electrically-driven valve substantially synchronously with the selective control of said force on said chamber to increase the capacity of said bellows hydraulic chamber, and a second driving mode including a second discharge step for discharging fluid out of said second pumping port by opening said second electrically-driven valve and shutting said first electrically-driven valve substantially synchronously with the selective control of said force on said chamber to decrease the capacity of said bellows hydraulic chamber, and a second suction step for intaking fluid into said first pumping port by shutting said second electrically-driven valve and opening said first electrically-driven valve substantially synchronously with the selective control of said force on said chamber to increase the capacity of said bellows hydraulic chamber;

a first bellows actuator coupled to said first pumping port;

a second bellows actuator coupled to said second pumping port;

a circular piece having a first end connected to said first bellows actuator and a second end connected to said second bellows actuator; and a rotary shaft driven by said circular piece whereby said shaft is incrementally rotated by said control means operable in said first driving mode or said second driving mode.

2. A pulse-actuated linear reciprocating driving gear comprising:

a bellows hydraulic chamber having a fluid capacity that may be decreased or increased by the selective application of a force applied in the axial direction thereof;

a piezoelectric actuator for applying said force in the axial direction of said bellows hydraulic chamber;

a first pumping port and a second pumping port;

a first electrically-driven valve installed between said bellows hydraulic chamber and said first pumping port having a valve lever and a piezoelectric actuator for displacing said valve lever to open and shut said valve;

a second electrically-driven valve installed between said bellows hydraulic chamber and said second pumping port having a valve lever and a piezoelectric actuator for displacing said valve lever to open and shut said valve;

a pulse supply for applying a pulse voltage to said piezoelectric actuator to generate pressure in the axial direction of said hydraulic chamber; and control means for implementing a first driving mode including a first discharge step for discharing fluid from said chamber through said first pumping port by opening said first electrically-driven valve and shutting said second electrically-driven valve substantially synchronously with the selective control of said force on said chamber to decrease the capacity of said bellows hydraulic chamber and a first suction step for intaking fluid into said chamber through said second pumping port by shutting said first electrically-driven valve and opening said second electrically-driven valve substantially synchronously with the selective control of said force on said chamber to increase the capacity of said bellows hydraulic chamber, and a second driving mode including a second discharge step for discharging fluid out of said second pumping port by opening said second electrically-driven valve and shutting said first electrically-driven valve substantially synchronously with the selective control of said force on said chamber to decrease the capacity of said bellows hydraulic chamber, and a second suction step for intaking fluid into said first pumping port by shutting said second electrically-driven valve and opening said first electrically-driven valve substantially synchronously with the selective control of said force on said chamber to increase the capacity of said bellows hydraulic chamber;

a first bellows actuator coupled to said first pumping port;

a second bellows actuator coupled to said second pumping port in such a manner that said first and second bellows actuators are linearly arranged and have respective operating ends facing each other; and a linear travel body arranged between said first and second bellows actuators and having a first end connected to said operating end of said first bellows actuator and a second end connected to said operating end of said second bellows actuator.

* * * * *